US005476199A

United States Patent [19]

Halverson et al.

[11] Patent Number: 5,476,199

[45] Date of Patent: Dec. 19, 1995

[54] EXTENDABLE CLOTHES HANGER

[76] Inventors: Carolyn M. Halverson, 202 E. Ann St., P.O. Box 188, Weyauwega, Wis. 54983; Paula R. Halverson, 7457 Kentland Ave., West Hills, Calif. 91307

[21] Appl. No.: 216,552

[22] Filed: Mar. 23, 1994

[51] Int. Cl.[6] ..... A47G 25/44

[52] U.S. Cl. ..... 223/94; 223/89

[58] Field of Search ..... 223/94, 89, 85, 223/92; 403/331, 335; 248/298; 211/113; D6/315, 318, 324, 328

[56] References Cited

U.S. PATENT DOCUMENTS

| | | | |
|---|---|---|---|
| D. 330,635 | 11/1992 | Licari . | |
| 2,053,633 | 9/1936 | Raternow | 223/95 |
| 2,500,817 | 3/1950 | Glassmeyer | 223/89 |
| 2,531,108 | 11/1950 | Casey | 223/89 |
| 3,799,412 | 3/1974 | Ahlgren . | |
| 5,052,599 | 10/1991 | Platti . | |
| 5,082,152 | 1/1992 | Chen . | |
| 5,085,358 | 2/1992 | Lam . | |

FOREIGN PATENT DOCUMENTS

| | | | |
|---|---|---|---|
| 1224378 | 9/1960 | France | 223/89 |

OTHER PUBLICATIONS

PCT/AU85/00103, Extendible Garment Harger, Kalet, Nov. 1986.

*Primary Examiner*—C. D. Crowder
*Assistant Examiner*—Bibhu Mohanty

[57] ABSTRACT

A clothes hanger having movably adjustable, extendable clothing support arms, enabling the side-to-side or lateral extent of the hanger to be adjusted or extended to fit clothing of different sizes. The movably adjustable hanger arms may both be independently and continuously adjustable from a fully withdrawn or non-extended position to a fully laterally extended position and are attached to each fixed or stationary inclined arm of the hanger by a multiplicity of frictionally engaging flexible gripping members cooperating with longitudinally extending grooves provided in the adjustable arms and the fixed arms of the hanger, respectively. The hanger may be made of molded, recycled plastic or polymer material.

7 Claims, 4 Drawing Sheets

EXTENDABLE CLOTHES HANGER

BACKGROUND OF THE INVENTION

1. Field of the Invention

The invention relates to adjustable clothes hangers for hanging clothes of various sizes with generally equal ease and facility.

2. Description of the Prior Art

Adjustable garment hangers are known in the prior art. For example, Darden, U.S. Pat. No. 3,802,611, discloses a hanger having adjustable trouser hanging means and a collapsible neck portion. McClenning, U.S. Pat. No. 3,874,572, shows a clothes hanger having extendable arms. The extendable arm sections are adapted to fit within channels in the main, supporting arms, said arms being rotatable at a central support position, under the hook. The movable arm sections fit within the channels in a sliding arrangement. Wang, U.S. Pat. No. 4,717 053, discloses a foldable miniature garment hanger having extendible and retractable arms. The extension arms fit within channels in a partially slidable arrangement. Karner, U.S. Pat. No. 4,391,395, shows a clothes hanger comprising a tubular central portion to telescopically hold slidable "end pieces" between inner and outer (extended) positions. Further, Gatling, U.S. Pat. No. 4,905,877, shows an adjustable garment hanger with a main body member having a pair of oppositely extending arms within a pair of sleeves that slide over the arms to provide hanger arms of variable lengths. Additionally, Chen, U.S. Pat. No. 5,082,152, shows a clothes hanger with a pair of extendible shoulder members telescopically mounted on a pair of basic shoulder members. Moreover, Lain, U.S. Pat. No. 5,085,358, shows a clothes hanger having adjustable arm lengths by means of extender arms mounted for pivoting and sliding movement along a support arms.

While the clothes hanger arrangements shown by the above prior art generally provide adjustable means for supporting garments of variable sizes, none of these patented hangers, together or combined, discloses or suggests the overall design, configuration, and material of the present invention, which is directed to clothes hangers that may be fabricated from molded, virgin or recycled polymer materials, and which hangers having adjustable left and right side members fixed to stationary supporting arms by the use of molded clamp members engaging grooves or slots in the fixed arms and the adjustable arms thereof. As such, the hanger according to the present invention achieves advantages in simplicity of construction, cost, and operational efficiency over the prior art all of which will be made apparent from the following description thereof. Other advantages of the present invention over the prior art also will be rendered evident.

SUMMARY OF THE INVENTION

To achieve the foregoing and other advantages, the present invention, briefly described, provides a clothes hanger having movably adjustable, extendable clothing support arms, enabling the side-to-side or lateral extent of the hanger to be adjusted or extended to fit clothing of different sizes. The movably adjustable hanger arms may both be independently and continuously adjustable from a fully withdrawn or non-extended position to a fully laterally extended position and are attached to each fixed or stationary inclined arm of the hanger by a multiplicity of frictionally engaging flexible gripping members cooperating with longitudinally extending grooves provided in the adjustable arms and the fixed arms of the hanger, respectively. The hanger preferably is made of molded, recycled plastic or polymer material.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the most preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved extendable clothes hanger which has all of the advantages of the prior art and none of the disadvantages.

It is another object of the present invention to provide a new an improved extendable clothes hanger which may be easily and efficiently manufactured and marketed.

It is a further objective of the present invention to provide a new and improved extendable clothes hanger that is of durable and reliable construction.

Another important object of the present invention is to provide an adjustable clothes hanger having the property of adjustable length, while maintaining strength through appropriate selection of materials and cross-sectional configuration.

A further object of the present invention is to provide an adjustable clothes hanger that may be used in closet spaces or other areas having a horizontal supporting pole positioned at a location with unequal frontal and rearward dimensions, such as, for example, closet spaces existing in some recreational vehicles and boats.

Still another object is to provide a clothes hanger that may be made of molded, virgin or recycled plastic or polymer material and mixtures thereof.

These and other objects are achieved in accordance with the present invention by the design and fabrication of an adjustable garment or clothes hanger having an easily adjustable left and right arm sections that may be extended to accommodate clothing of different sizes. The clothes hanger of the present invention may be used not only for smaller than average garments, but also for larger than average. As is well known, clothing having a size larger than average will tend to fall off of the conventional hanger designed only for average sizes. Moreover, the hanger of the present invention may be employed in smaller than usual, cramped or asymmetrical configured closest spaces because the extension arms may be adjusted to fit such conditions. Finally, the adjustable clothes hanger of the present invention may be made (e.g. molded) from virgin or recycled polymer material, or mixtures thereof, and thus, is environmentally friendly.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference now should be had to the accompanying drawings and description matter in which there are illustrated mostly preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
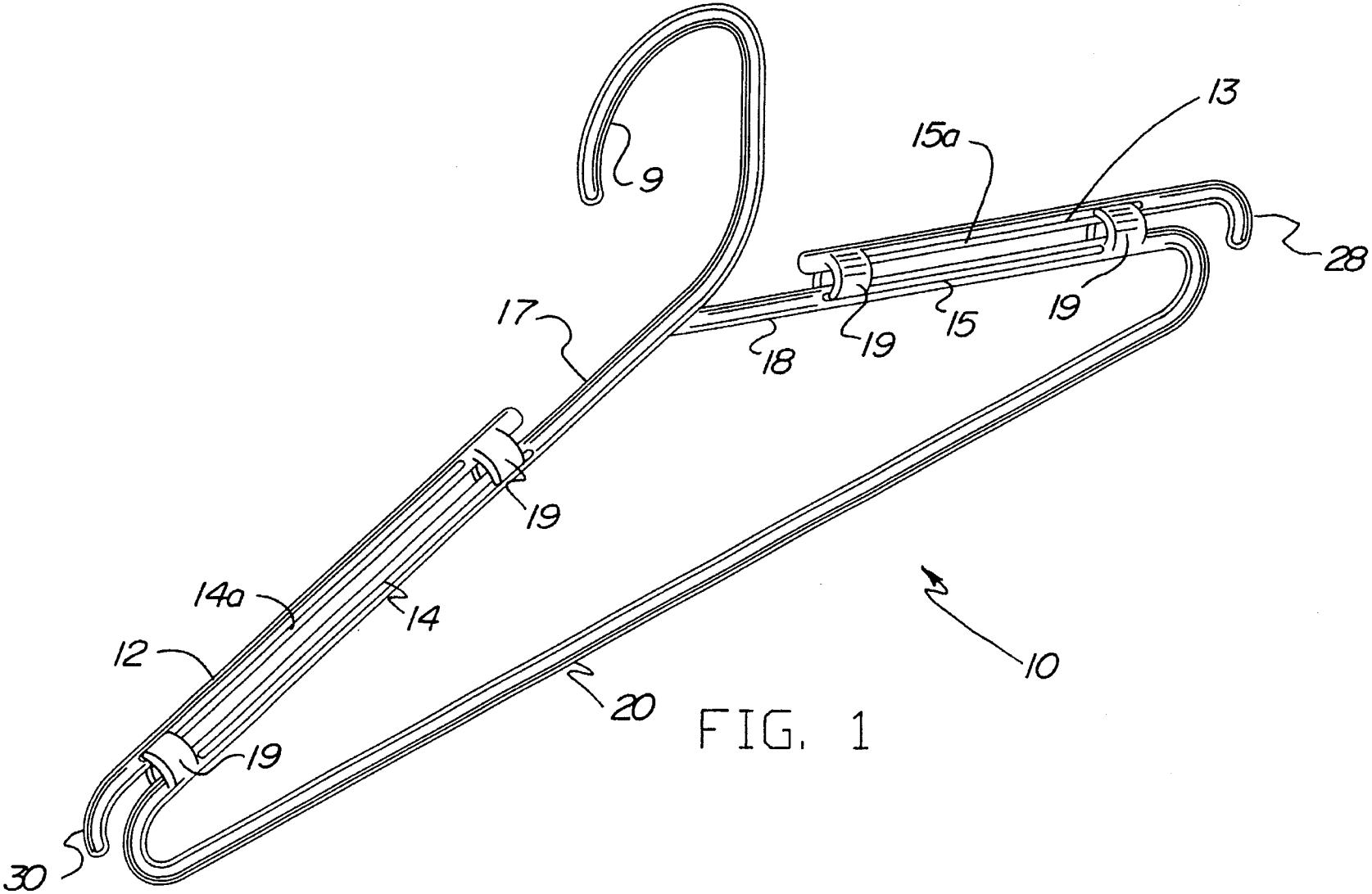
FIG. 1 is a perspective view of the hanger of the present invention.

With reference now to the drawings, a new and improved extendable clothes hanger embodying the principles and concepts of the present invention will be described.

Turning initially to FIGS. 1–9, there is shown the mostly preferred embodiment of the extendable clothes hanger apparatus of the present invention generally designated by reference numeral 10.

More specifically, as shown in FIG. 1, the hanger of the present invention has the usual triangular overall shape and comprises a hook 9 in contiguous joined relationship with an integral left side arm 17 and integral right side arm 18. The arms 17 and 18 are joined together at their extreme distal ends through lower horizontal structural member 20.

In accordance with the invention, a pair of extension arms 12 and 13 are slidably connected, respectively, to arms 17 and 18 by means of a series of flexible clamps or gripping members 19. Each flexible clamp 19 has a pair of opposed arcuate shaped fingers 21 and 22 terminating at their distal ends in an inwardly facing protuberance 23, 24 substantially as shown. Each protuberance in turn, extends into and frictionally engages a corresponding longitudinally extending groove or slot 14, 14*a* or 15, 15*a* provided in arms 17, 18 on the one hand and slidable extension arms 12 and 13 on the other hand. Fingers 21 and 22 are integrally attached at their base to non-adjustable hanger arms 17, 18 and adjustable extension arms 12 and 13 and are slightly flexible to permit easy installation and removable by snap fit or removal of the protuberances relative to the grooves as will be apparent in an obvious manner. By this construction, arms 12, 13 may be slidably displaced to any fixed relative position on arms 17, 18 with the range of displacement being defined by the longitudinal extent of grooves 4, 14*a* 15, and 15*a*.

Figure 2:
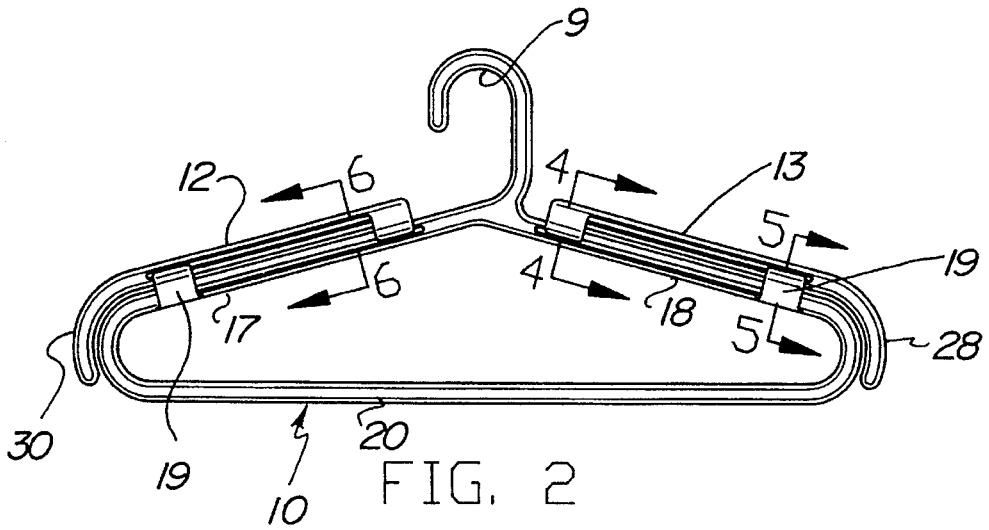
FIG. 2 shows an elevational view of the hanger of FIG. 1 with the extension arms positioned inwardly.
Figure 3:
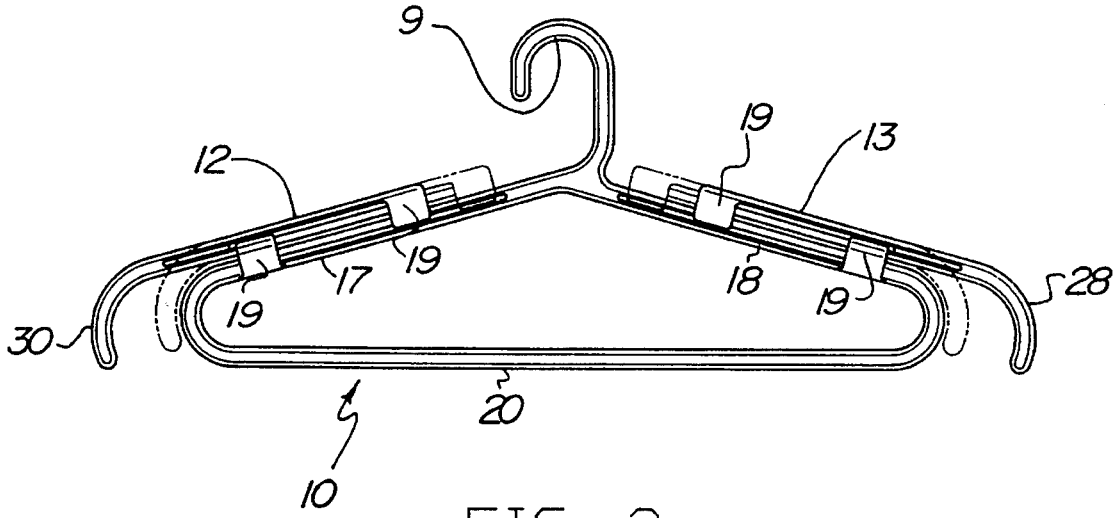
FIG. 3 shows an elevational view of the hanger of FIG. 1 with the extension arms positioned outwardly.

FIGS. 2 and 3 illustrate the slidable movement from a fully withdrawn position (FIG. 2) to a position where extensible arms are withdrawn laterally approximately one-third of their range of motion. It will be appreciated that the arcuate finger-like clamps 9 may be attached contiguously to their respective arm parts by molding as is believed well known in the plastics forming art.

As indicated by FIG. 3, the adjustable arms 12, 13 may be extended to an outward (laterally extended) position, either individually or together, to make what would be a hanger having a length-wise dimension of about 12 inches into a hanger having a length of about 20 inches, for example. However, in some circumstances it will be apparent that the extension arms may be unequally distended, especially when it is desired to use the hanger in a narrow closet spaces such as those found on a boat or a recreational vehicle (RV).

Figure 4:
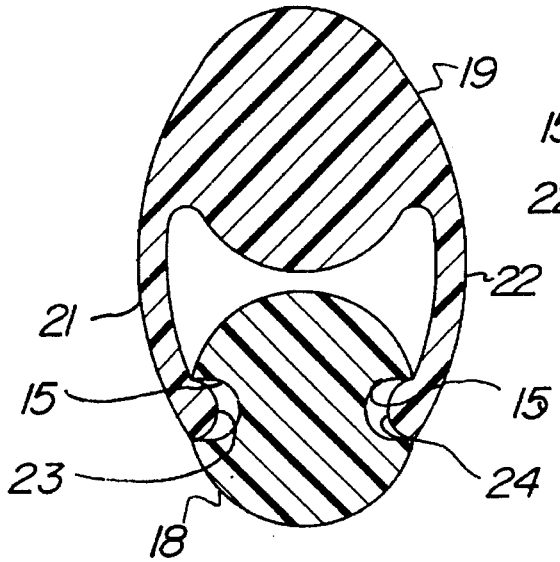
FIG. 4 shows a cross-sectional view taken along line 4—4 of FIG. 2.
Figure 5:
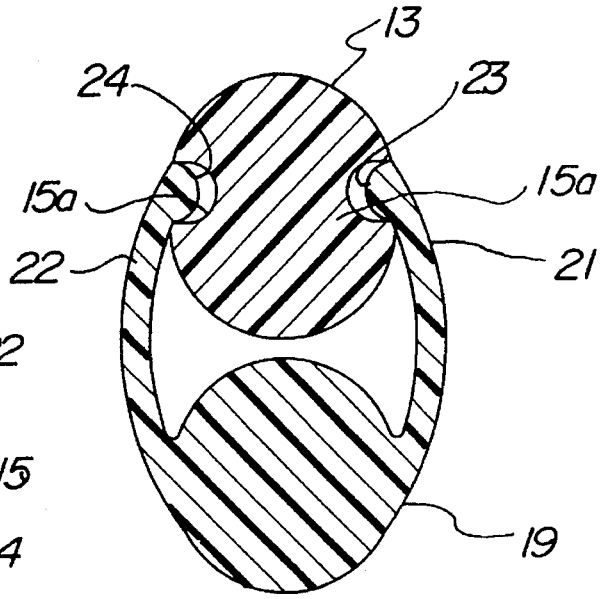
FIG. 5 shows a cross-sectional view taken along line 5—5 of FIG. 2.
Figure 6:
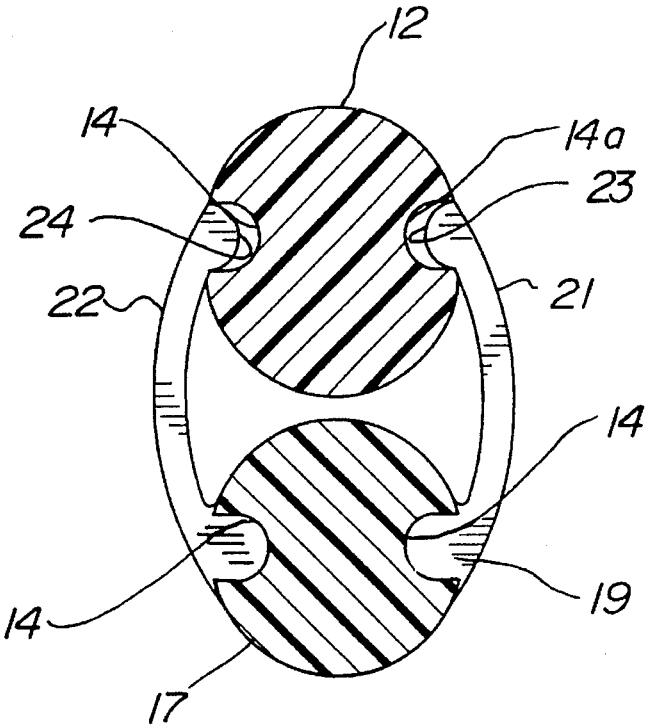
FIG. 6 shows a cross-sectional view taken along line 6—6 of FIG. 2.

As shown by FIGS. 4 through 6, the cross-sectional shape of the hanger parts described above may assume an elliptical or generally circular cross-sectional configuration in order to gain obvious structural advantages from molded plastic or polymer materials.

Figure 9:
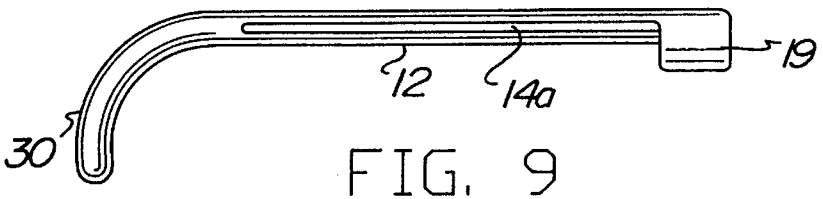
FIG. 9 shows an elevational view of only the leftmost extension arm of the hanger illustrated in FIGS. 1 through 6.
Figure 8:
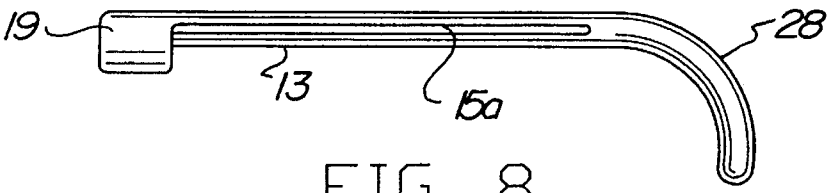
FIG. 8 shows an elevational view of only the rightmost extension arm of the hanger illustrated in FIGS. 1 through 6.
Figure 7:
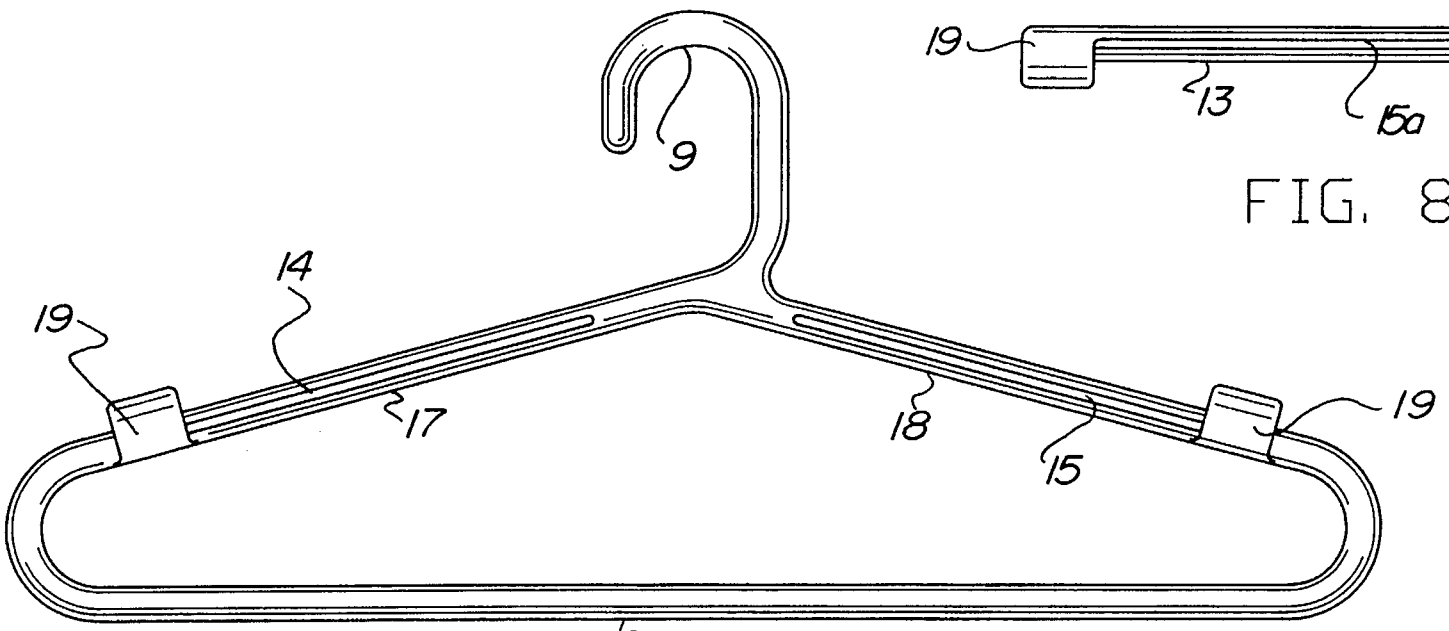
FIG. 7 shows an elevational view of the hanger of FIG. 1 without the extension arms assembled thereto.

FIGS. 7, 8 and 9 show the separate members of the clothes hanger of the present invention in an unassembled condition. As shown in FIG. 8, extension arm 12 terminates at its rightmost end in clamping member 19 and terminates in its opposed leftmost end in a curved portion 28 which serves to define a sloped shoulder for the extension arm facilitating insertion into the arm or sleeve portions of a garment, and secondly as a convenient handle or grip for sliding the extension arm on its corresponding fixed hanger arm 17. The elongated middle portion of arm 12 is straight and includes grooves 14*a*.

In similar fashion, FIG. 9 shows extension arm 13 which terminates at its leftmost end in clamping member 19 and terminates in its opposed rightmost end in a curved shoulder portion 30, The elongated middle portion of arm 13 also is straight and includes grooves 15*a*.

In assembling arms 12 and 13 on hanger 10 (FIG. 7), all that is necessary is to snap fit the various flexible clamps 19 of the hanger parts into their respective grooves 14, 14*a*, 15 and 15*a* in a manner now believed apparent.

The selection of suitable materials for making the hanger and for obtaining optimum structural results, in the light of the disclosed utility of the present invention, is considered to be within the skill of an ordinary worker in the art, and the invention is particularly suitable for using plastic or polymer materials that have previously been used for other articles, namely, recycled plastics, such plastics commonly known as thermoplastic polymers, though, obviously, inorganic and organic filler materials may be included within such compositions or materials.

It is apparent from the above that the present invention accomplishes all of the objectives set forth by providing a new and improved extendable clothes hanger having movably adjustable, extendable clothing support arms, enabling the side-to-side or lateral extent of the hanger to be adjusted or extended to fit clothing of different sizes. The movably adjustable hanger arms may both be independently and continuously adjustable from a fully withdrawn or non-extended position to a fully laterally extended position and are attached to each fixed or stationary inclined arm of the hanger by a multiplicity of frictionally engaging flexible gripping members cooperating with longitudinally extending grooves provided in the adjustable arms and the fixed arms of the hanger, respectively. The hanger may be made of molded, recycled plastic or polymer material.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new, and is desired to be protected by LETTERS PATENT of the United States is as follows:

1. An adjustable clothes hanger comprising:

a hook having a lower end;

a left side arm projecting from the lower end of the hook at an oblique angle oriented downwardly relative thereto, and a right side arm projecting from the lower end of the hook at an oblique angle oriented downwardly relative thereto, the left and right side arms projecting in opposite directions from the lower end of the hook and residing in a common plane, the left side arm including a pair of left side arm longitudinal grooves extending longitudinally along opposed sides thereof, and the right side arm including a pair of right side arm longitudinal grooves extending longitudinally along opposed sides thereof;

a left extension arm positioned above the left side arm and residing within the common plane, and a right extension arm positioned above the right side arm and residing within the common plane;

a left side arm gripping means for removably and slidably coupling the left extension arm relative to the left side arm, the left side arm gripping means comprising a pair of arcuately shaped left extension arm fingers mounted to opposed sides of the left extension arm, the left extension arm fingers each terminating in a left extension arm protuberance, wherein the left extension arm protuberances are oriented so as to extend towards one another, the left extension arm protuberances extending into the left side arm longitudinal grooves extending longitudinally along opposed sides of the left side arm;

a right side arm gripping means for removably and slidably coupling the right extension arm relative to the right side arm, the right side arm gripping means comprising a pair of arcuately shaped right extension arm fingers mounted to opposed sides of the right extension arm, the right extension arm fingers each terminating in a right extension arm protuberance, wherein the right extension arm protuberances are oriented so as to extend towards one another, the right extension arm protuberances extending into the right side arm longitudinal grooves extending longitudinally along opposed sides of the right side arm;

wherein the left extension arm includes a pair of left extension arm longitudinal grooves extending longitudinally along opposed sides thereof, and the right extension arm including a pair of right extension arm longitudinal grooves extending longitudinally along opposed sides thereof;

and further comprising a left extension arm gripping means for removably and slidably coupling the left side arm relative to the left extension arm, the left extension arm gripping means comprising, pair of arcuately shaped left side arm finges mounted to opposed sides of the left side arm, the left side arm fingers each terminating in a left side arm protuberance, wherein the left side arm protuberances are oriented so as to extend towards one another, the left side arm protuberances extending into the left extension arm longitudinal grooves extending longitudinally along opposed sides of the left extension arm;

and, a right side arm gripping means for removably and slidably coupling the right side arm relative to the right extension arm, the right extension arm gripping means comprising a pair of arcuately shaped right side arm fingers mounted to opposed sides of the right side arm, the right side arm fingers each terminating in a right side arm protuberance, wherein the right side arm protuberances are oriented so as to extend towards one another, the right side arm protuberances extending into the right extension arm longitudinal grooves extending longitudinally along opposed sides of the right extension arm.

2. The adjustable clothes hanger of claim 1, wherein the left extension arm terminates at its leftmost end in a left downwardly curved shoulder portion, and further wherein the right extension arm terminates at its rightmost end in a right downwardly curved shoulder portion.

3. The adjustable clothes hanger of claim 2, wherein the arms are substantially circular in cross section.

4. The adjustable clothes hanger of claim 2, and further comprising a lower horizontal structural member extending between outer ends of the side arms.

5. The adjustable clothes hanger of claim 3, wherein the side arm gripping means are each located proximal to a juncture of the respective side arm and the lower horizontal structural member.

6. The adjustable clothes hanger of claim 5, wherein the left extension arm terminates at its leftmost end in a left downwardly curved shoulder portion, and further wherein the right extension arm terminates at its rightmost end in a right downwardly curved shoulder portion.

7. The adjustable clothes hanger of claim 6, wherein the extension arm gripping means are each located opposite the downwardly curved shoulder portion of the respective extension arms.

* * * * *